US005512745A

United States Patent [19]

Finer et al.

[11] Patent Number: 5,512,745

[45] Date of Patent: Apr. 30, 1996

[54] OPTICAL TRAP SYSTEM AND METHOD

[75] Inventors: Jeffrey Finer, Palo Alto, Calif.; Robert Simmons, Middlesex, United Kingdom; James A. Spudich, Palo Alto; Steven Chu, Stanford, both of Calif.

[73] Assignee: Board of Trustees of the Leland Stanford Jr. University, Palo Alto, Calif.

[21] Appl. No.: 208,131

[22] Filed: Mar. 9, 1994

[51] Int. Cl.[6] ..... H05H 3/04

[52] U.S. Cl. ..... 250/251

[58] Field of Search ..... 250/251

[56] References Cited

U.S. PATENT DOCUMENTS

| | | | |
|---|---|---|---|
| 4,023,158 | 5/1977 | Corcoran | 250/251 |
| 4,092,535 | 5/1978 | Ashkin et al. | 250/251 |
| 4,893,886 | 1/1990 | Ashkin et al. | 350/1.1 |
| 5,079,169 | 1/1992 | Chu et al. | 436/172 |
| 5,308,976 | 5/1994 | Misawa et al. | 250/251 |
| 5,327,222 | 7/1994 | Makoto et al. | 356/356 |

OTHER PUBLICATIONS

"Force of Single Kinesin Molecules Measured with Optical Tweezers" Science, vol. 260, Apr. 9, 1993, pp. 232–234, Kuo et al.

"Bead Movement by Single Kines Molecules Studied with Optical Tweezers" Block et al., Nature, vol. 348, 22 Nov., pp. 348–352.

Scientific American, Feb. 1992, vol. 266, No. 2.

Laser Manipulation of Atoms and Particles, Steven Chu, Science, 23 Aug., 1991, vol. 253, pp. 861–866.

"Observation of a Single–Beam Gradient Force Optical Trap for Dielectric Particles", Ashkin et al, Optics Letters, vol. 11, May 1986.

International Conference—Muscle as a Machine: Energy Transduction in the Contractile System, Apr. 13–15, 1992, Lawton Chiles International House.

In Vitro Methods for Measuring Force and Velocity of the Actin–Myosin Interaction Using Purified Proteins, Warrick et al., pp. 1–21, Methods In Cell Biology vol. 39, 1993.

*Primary Examiner*—Bruce C. Anderson

*Attorney, Agent, or Firm*—Flehr, Hohbach, Test, Albritton & Herbert

[57] ABSTRACT

By providing a focal region of light onto a particle, a laser-based light source can provide enough radiation pressure to position the particle at any desired location in space. In one application, the particle can be a micrometer-sized bead, called a handle, attached to a sample. When the sample under examination, such as an actin filament, interacts with other molecules, such as myosin, the forces generated may displace the sample, and thus the handle, out of its original position. To correct for the off-target position (or in other words, to increase the stiffness of the handle), a feedback loop that utilizes a quadrant photodiode detector and a focal region location means such as an acousto-optic modulator or galvanometer mirror is incorporated in the optical trap system. Use of two other light sources for brightfield illumination and epifluorescence allows the simultaneous viewing of the sample in real time. In other embodiments, the optical trap system can trap and manipulate particles.

8 Claims, 9 Drawing Sheets

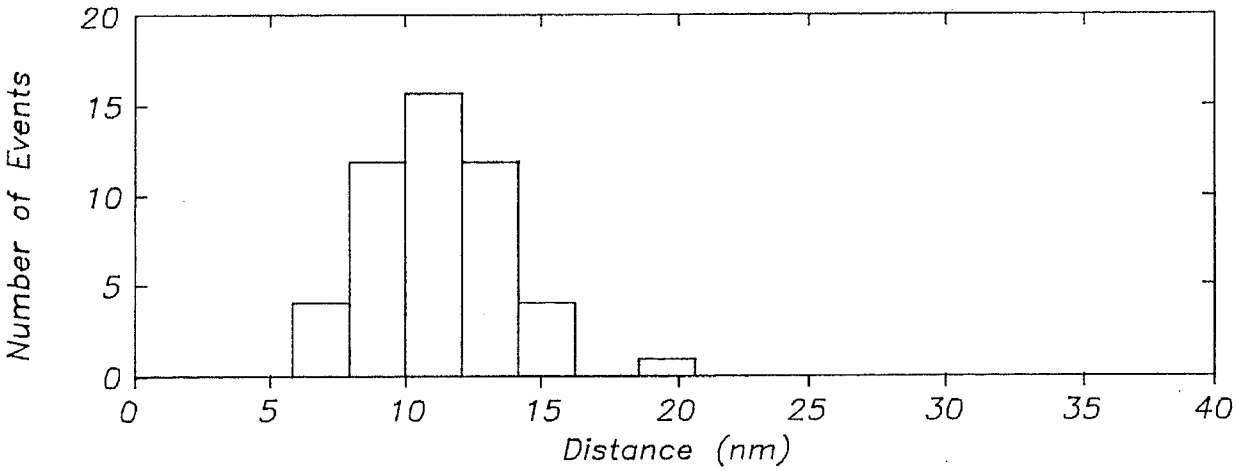
FIG.—6C
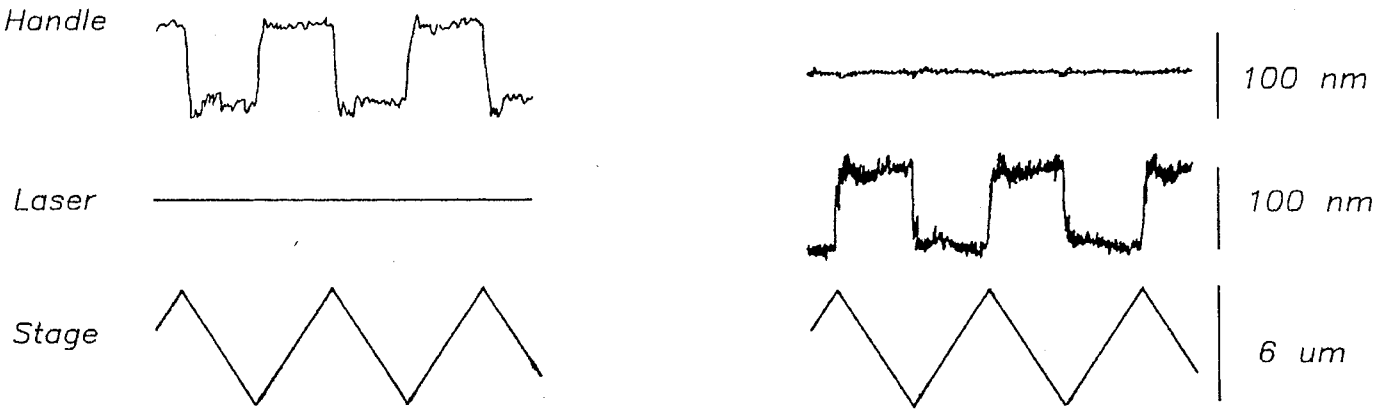
FIG.—7B
FIG.—7A

OPTICAL TRAP SYSTEM AND METHOD

This invention was made with United States Government support under Contract No. GM 33289 awarded by the National Institutes of Health. The Government has certain rights in this invention.

BRIEF SUMMARY OF THE INVENTION

The present invention relates generally to an optical trap system and more particularly to an apparatus and method of using an optical trap system with feedback positional control.

BACKGROUND OF THE INVENTION

Optical traps, or sometimes referred to as optical tweezers, utilize a light source to produce radiation pressure. Radiation pressure is a property of light that creates small forces by absorption, reflection, or refraction of light by a dielectric material. Relative to other types of forces, the forces generated by radiation pressure are almost negligible—only a few picoNewtons (1 pN=$1\times10^{-12}$ N) from a light source of a few milliwatts of power. However, a force of a few picoNewtons is more than sufficient to represent the interactions of microscopic molecules such as actin and myosin in the presence of adenosine triphosphate (ATP).

The present invention utilizes the gradient force that exists when a transparent material with a refractive index greater than the surrounding medium is placed in a light gradient. As light passes through polarizable material, it induces a dipole moment. This dipole interacts with the electromagnetic field gradient, resulting in a force directed towards the brighter region of the light, normally the focal region. However, if an object has a refractive index lower than the surrounding medium, such as an air bubble in water, the object experiences a force drawing it toward the darker region. Optical traps utilize brighter regions or focal points of light to draw the specimen toward the direction of the focal region of the light source.

As long as the frequency of the laser is below the natural resonances of the particle being trapped (e.g., the absorption edge of a polystyrene sphere), the dipole moment is in phase with the driving electric field. The energy of the particle can be described as $$W=-p\cdot E$$

where,

W=energy of the induced dipole in the electric field p=induced dipole moment of the particle E=electric field Thus, the particle minimizes its energy by moving to the region where the electric field is the highest, namely the focal point of the laser beam.

A simplified model of the optical trap is as follows: light, such as laser light, enters a high numerical aperture objective lens of an optical system and is focused to a diffraction-limited region or spot on a spherical object in the specimen plane. Because the intensity profile of the laser light is not uniform, an imbalance in the reaction forces generates a three-dimensional gradient force with the brightest light in the center. The gradient force pulls the object toward the brighter side. Thus, the picoNewton forces generated by the optical system "traps" the object. Such gradient forces are formed near any light focal region.

The sharper or smaller the focal region, the steeper the gradient. To overcome scattering forces near the focal region and hence prevent the object from being ejected along the direction of the light beam, the optical system must produce the steepest possible gradient forces. Sufficiently steep gradient forces can be achieved by focusing laser light to a diffraction-limited spot of diameter of approximately $\lambda$, the laser light wavelength, through a microscope objective of high numerical aperture (N.A.). Appropriately enough, this single-beam gradient force optical trap is also known as "optical tweezers."

The magnitude of forces produced by this optical system is on the scale of picoNewtons. These lower magnitude forces are the kinds of forces encountered at the biological ultrastructure level. PicoNewton size forces can move cells, bend cell elements, impede organelle or bacteria movements, and overcome the motion of biological motors, such as myosin and kinesin.

One embodiment of the present invention utilizes optical traps to study motor molecules, where the forces generated by these mechanoenzymes are in the picoNewton range. Micrometer-sized spheres called "handles" can be attached to a sample such as an actin filament. These micrometer-sized handles can be, for example, refractile silica or latex spheres. These handles are optically trappable by a focused laser light source. Additionally, their symmetry and uniform content facilitate calibration against Stokes' drag.

Note that these handles attached to the sample are a narrow class of particles that can be optically trapped. In fact, the present invention, through its embodiments, can be used with any opticaly trappable particle. Any neutral particle that can be manipulated by the small scale negative radiation pressure formed by a focal region of a light source can be used. The particle can be, among other things, an atom, a dielectric particle whose size is in the range of 10 μm to approximately 25 nm, a Mie particle, and a Rayleigh particle.

The particles trapped by the focal point of the light, and thus the attached sample, can be steered with lenses, galvanometer mirrors, and other optical devices. Multiple optical traps can also be utilized for various assay purposes such as spatial orientation and pulling taut a sample. Multiple optical traps expand upon the utility of single optical traps.

Prior optical traps had little or no stiffness; that is, the particles trapped by the optical trap did not maintain their desired on-target position. Furthermore, these multiple optical traps did not use feedback signals to stably hold the position of the particles in both the x and y directions in the sample region. With feedback, the optical trap system can be used to stiffen the particle's position for greater flexibility in particle manipulation. In one of many applications, an optical trap system with feedback can be used to study and measure the interaction and forces of the surrounding protein motor molecules, such as myosin, with the "handled" molecule, such as actin filament. The level of feedback signal required to close the loop and hold the molecules in a stable location also provides a measure of the force generated by the trapped object. Accordingly, an embodiment of the present invention can measure the force produced by a single myosin molecule as they move against a single actin filament in the presence of varying concentrations of ATP. Two traps with feedback position control are used so that a flexible actin filament can be manipulated and stretched taut between two handles in space.

During muscle contraction chemical energy from ATP hydrolysis is converted to relative sliding of actin and myosin filaments to produce force. Although the actomyosin system has been extensively studied, the mechanism underlying its mechanochemical energy action remains unknown. The conventional swinging crossbridge theory suggests that for each ATP hydrolysis, myosin binds to actin and undergoes a conformational change or power stroke before subsequently detaching. This theory assumes that the myosin step size, or movement of actin relative to myosin for each ATP hydrolysis, is less than 40 nm, a value limited by the physical dimensions of the myosin head. Recently, various studies showed step sizes that were inconsistent with the conventional theory. To resolve this issue, the present invention provides a new technique with the resolution to probe the mechanical properties of myosin at the level of single molecular events.

The optical trap technique disclosed herein can measure single molecular events, such as displacement and force, and offers advantages over other force measuring techniques such as the use of microneedles. The advantages include ease of use and, with feedback positional control, the ability to change the stiffness of the trap in the middle of an experiment. In one experiment conducted with an embodiment of the present invention, the optical trap with feedback in motility assays allowed the measurement of nanometer movements and picoNewton forces at millisecond rates of samples on a coverglass. By adding a second optical trap an actin filament can be held and manipulated via beads, or handles, attached to each end of the actin filament which prevents the actin filament from diffusing away from surfaces sparsely coated with myosin. By placing myosin molecules on a bead support above the coverglass surface, interactions of either the actin filament or the handles with the microscope coverslip surface are minimized. An electronic feedback system allowed the measurement of forces under approximately isometric conditions.

OBJECTS AND SUMMARY OF THE INVENTION

An object of the present invention is to provide an optical imaging system that utilizes a single or multiple optical trap.

Another object of the present invention is to utilize closed loop feedback signals to control the two-dimensional position of the optically trapped particle.

A further object of the present invention is to provide a stiff optical trap for measuring actin filament displacement and force with myosin in the presence of ATP. This device may utilize beads as handles to pull taut the actin filament and suspend it above a silica bead support coated with myosin molecules.

The foregoing and other objects of the present invention may be achieved by an optical trap system to trap a particle with the focal region of a light source comprising a focal region location means to bend optical trap light and position the focal point at a desired location, an optical processing means to direct a focal region of the light onto the particle to form the optical trap and to direct an image of the particle onto a detector, a detector for detecting a position of the particle image and generating a signal representative of the deviation of the position of the particle image from a desired target position of the particle image, and a driver for using the signal to generate a drive signal to the focal region location means to correct for off-target displacements of the focal region.

In one embodiment of the present invention, this optical system may be used to observe the interaction of a single myosin molecule with the actin filament. With feedback providing the nano-metric positional control of the focal region, the actin filament may be held in place to determine the force transduced when a myosin molecule interacts with the actin filament.

BRIEF DESCRIPTION OF THE DRAWINGS

The above objects and description of the present invention may be better understood with the aid of the following text and accompanying drawings.

FIG. 5A shows actin filament displacement in the presence of 2 mM of ATP (at saturation).

FIG. 5B shows actin filament displacement in the presence of 10 μM of ATP.

FIGS. 6A–C show the displacement of the actin filament at subsaturating densities of heavy meromyosin (HMM).

FIG. 6A shows large actin filament displacement followed by abrupt return to its original position.

FIG. 6B shows discrete step levels of the actin filament movement before returning to the original position.

FIG. 6C shows a histogram of the frequency of occurrence for each displacement distance.

FIGS. 7A–C show force measurements with and without feedback positional control.

FIG. 7A shows the handle displacement when no feedback was incorporated.

FIG. 7B shows the handle displacement when feedback was incorporated.

FIG. 7C shows the relationship between applied force and handle displacement.

FIG. 8A shows single force displacements at an ATP concentration of 2 mM and low HMM density.

FIG. 8B shows single force displacements at an ATP concentration of 10 μM and low HMM density.

FIG. 8C shows single force displacements at an ATP concentration of 1 μM and low HMM density.

FIG. 8D is a histogram of the frequency of occurrence of various forces.

DETAILED DESCRIPTION OF PREFERRED EMBODIMENTS

The present invention is an apparatus and method of using an optical system employing an optical trap to position a particle in a desired location on a sample region. With feedback positional control, the position of the particle can be maintained; that is, the optical trap can be stiffened to minimize any displacements of the particle. In one application, the particle can be a micrometer-sized bead, called a handle, attached to a sample. By increasing the stiffness of the sample, users of the optical system can observe and measure the sample's interaction with the surrounding medium and other molecules. This is accomplished with the aid of handles attached to the sample and a laser light source to produce the focal region, and hence the gradient forces, to manipulate the handles toward the bright focal region.

Figure 1:
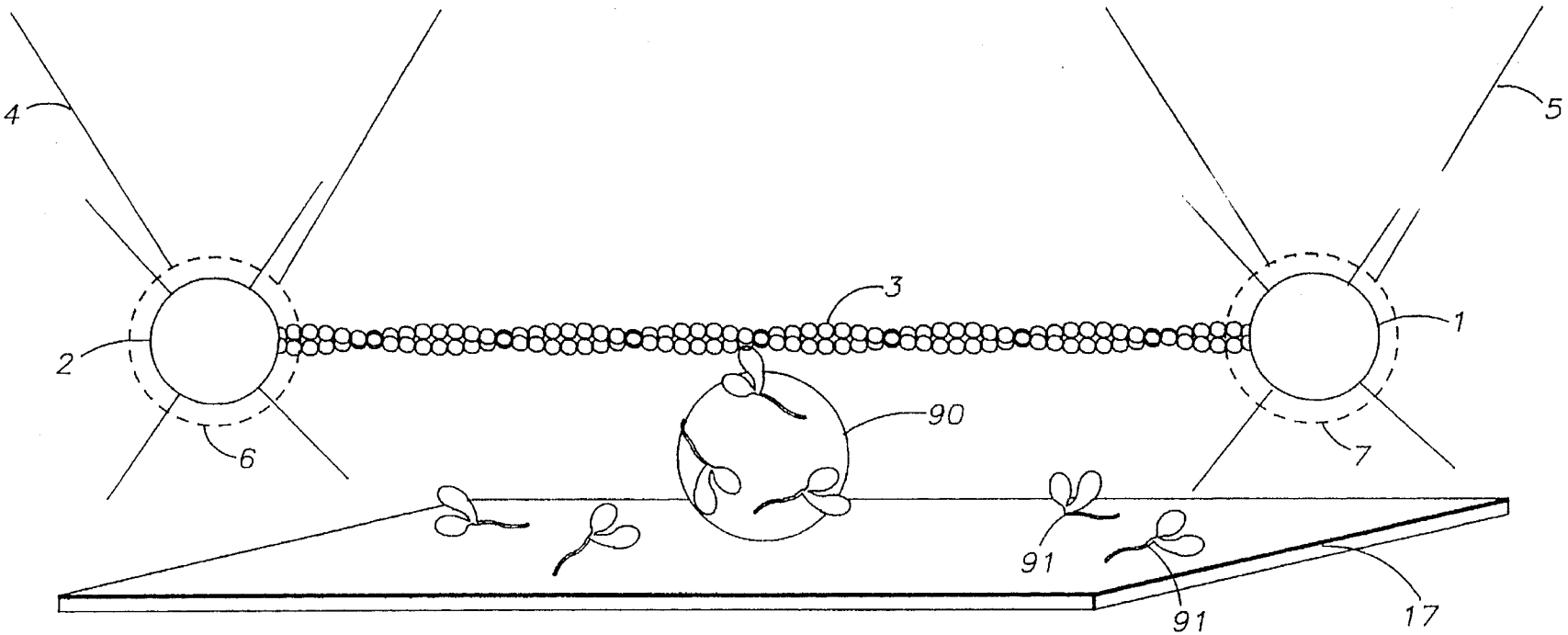
FIG. 1 is a close-up view of the two focal regions where the beads, or handles, are levitating or positioning a sample such as an actin filament.

FIG. 1 shows a close-up view of one embodiment of the present invention. The micrometer-sized beads, also known as handles 1, 2, hold a sample 3 at each end. As an example, the sample 3 can be an actin filament. Each handle 1, 2 may be trapped by an optical trap light beam. The optical system (not shown in FIG. 1) produces sharp laser beams 4, 5 toward the handles 1, 2. The laser beams produce a steep gradient force of picoNewton proportions at each handle through each focal region 6, 7. The gradient forces suspend or levitate each handle 1, 2 toward the light source. Because the handles 1, 2 are attached to the sample 3, the sample 3 is also levitated. Thus, the sample 3 may be raised, lowered, or moved side to side by manipulating the handles with the focal region of the laser beam. The degree of brightness of the laser beams 4, 5 dictates the degree of levitation.

Because two focal regions are needed to manipulate the two handles 1, 2, two lasers could be used. Alternatively, one laser may be used with an optical scheme that will "split" the single laser beam into two or more laser beams.

Figure 2:
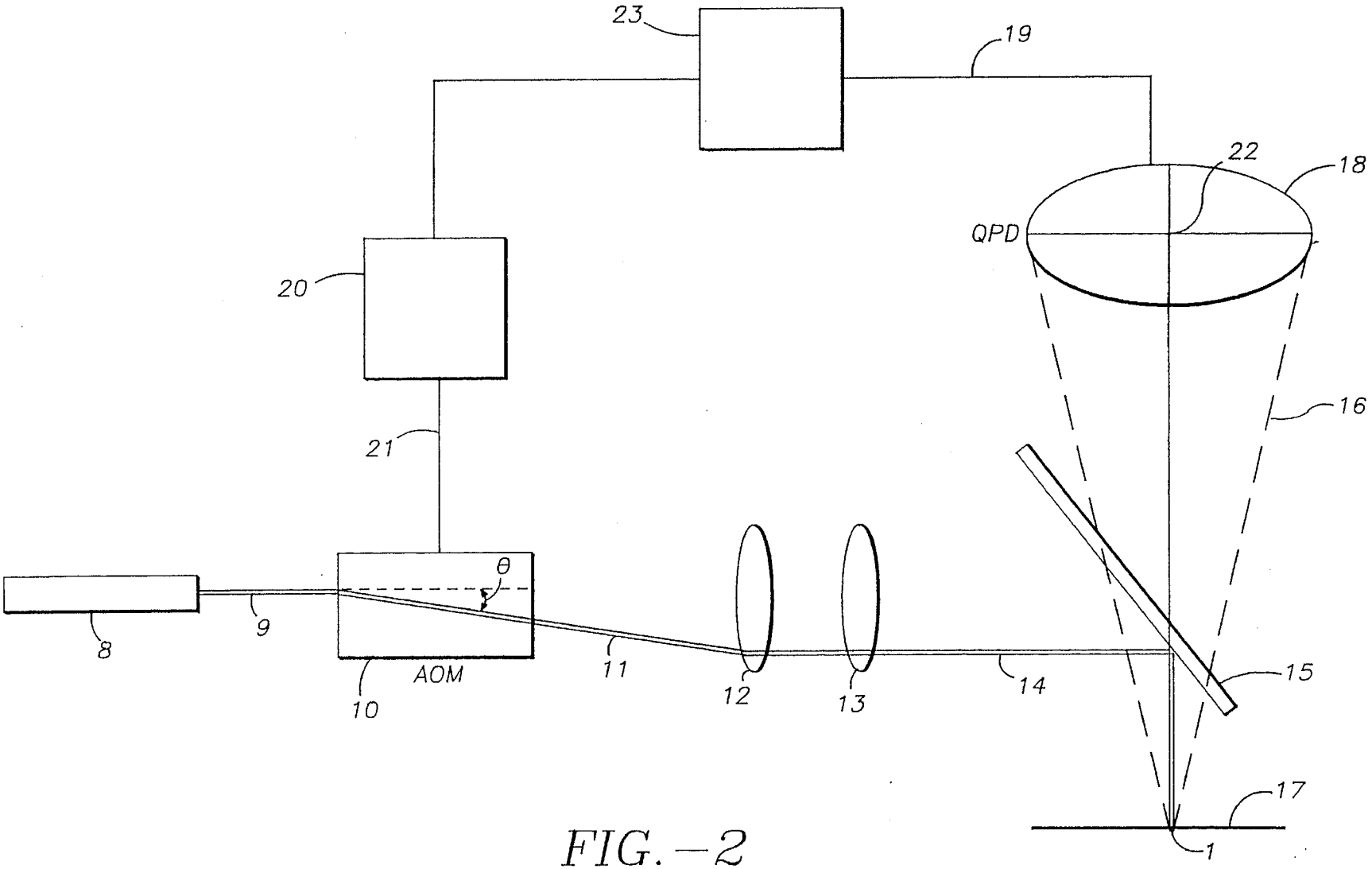
FIG. 2 is one embodiment of the present invention showing an optical system with feedback to correct displacement in the x-axis (y constant) interfacing with the handle.

In FIG. 2, an embodiment of the present invention is shown with one optical trap. To optically trap the handle 1, a light source with an optical processing system must provide a focal region at the location of the handle 1. Light source 8 provides the light for the focal region necessary to form an optical trap. For stable optical trapping of the micrometer-sized handle 1, the light source 8 may be a laser generating laser beams in the milliwatt to watt range to create gradient forces of several picoNewtons. The gradient force is proportional to the light power. To avoid excessive heating or photodamage, the light must provide a convenient wavelength in the infrared range (1,064 nm or approximately 1 μm) to minimize its absorption by biological tissue.

One such laser is Nd:YAG, a solid-state laser which utilizes a YAG crystal with Nd impurity ions. Neodymium (Nd) ions can provide laser action in many host materials to produce outputs in the infrared region (approximately 1 μm). YAG (yttrium aluminum garnet) crystal can produce output powers up to a kilowatt. Because Nd:YAG is a four-level laser, population inversion is easier to maintain and thus require relatively low pumping light intensity for laser action. Other suitable lasers include diode lasers in the near infrared region (780–950 nm) for low power and titanium-sapphire laser (for right combination of higher power and wavelength for biological use). One particular type of diode laser is Nd:YLF made by Spectra-Physics, TFR, at 1.047 μm.

Laser light source 8 generates a light beam 9 of suitable power and wavelength. Light 9 enters a focal region location means, such as an Acousto-Optic Modulator (AOM) 10. The AOM 10 provides a crystal through which the light passes to deflect the light at a desired angle θ. The operation of the AOM is based on the principle of scattering light by sound waves. More specifically, refraction and diffraction effects occur when light passes through a transparent medium at an angle (typically right angle) to a high-frequency sound wave propagating in the same medium. The interaction of the light beam with the acoustic beam causes a change in the index of refraction of the medium and can result in light beam deflection and modulation of the polarization, phase, frequency, or amplitude of the light wave energy.

In one embodiment of the present invention, the character of the sound wave generated by voltage-controlled oscillator (VCO) 20 and traveling through line 21 into AOM 10 determines the angle θ of the light beam deflection in the AOM 10. Deflected light 11 emerging from the AOM 10 enters collimating lens 12 and focusing lens 13. The focused light 14 emerging from the lenses 12, 13 reaches dichroic filter 15 where the focused light is redirected to microscope coverslip 17 and onto the handle 1. The focused light on the handle 1 produces an optical trap.

Image light 16 reflected from the handle 1 and coverslip 17 passes through the dichroic filter 15 and onto a Quadrant Photodiode Detector (QPD) 18. A photodiode detector produces current flow, or photocurrent, in an external circuit connected to the PN junction when light falls on the detector. The PN junction must be suitably doped and biased to produce hole-electron pairs. A quadrant photodiode detector (QPD) measures displacement of the image along two dimensions, Δx and Δy, away from the desired target. In FIG. 2, the desired target 22 on QPD 18 includes a reference on-target position for the handle 1 to maintain a steady position.

The displacement Δx, Δy determines the content of the photocurrent generated in line 19. For the embodiment of FIG. 2, the displacement is along one axis (Δx variable and Δy constant). To correct the displacement, feedback signal in the form of the photocurrent on line 19 is converted to a proportional voltage at electrometer 23. The appropriate correction voltage is applied to VCO 20. Depending on the voltage applied, the VCO 20 generates an appropriate sound wave to AOM 10 to deflect the light beam 9 in AOM 10 at the desired angle θ to position the focal region, and thus the optical trap and handle, at the desired on-target location. The position of the handle is detected by QPD 18 which sends the appropriate photocurrent, if any, to correct for off-target handle positions. Thus, if the handle is on the desired on-target position, the QPD 18 does not send a correction signal back to the VCO 20 and AOM 10 (or the QPD sends a predetermined constant signal representing no displacement). Thus, QPD 18, electrometer 23, VCO 20, and AOM 10 form the closed loop feedback system.

Figure 3:
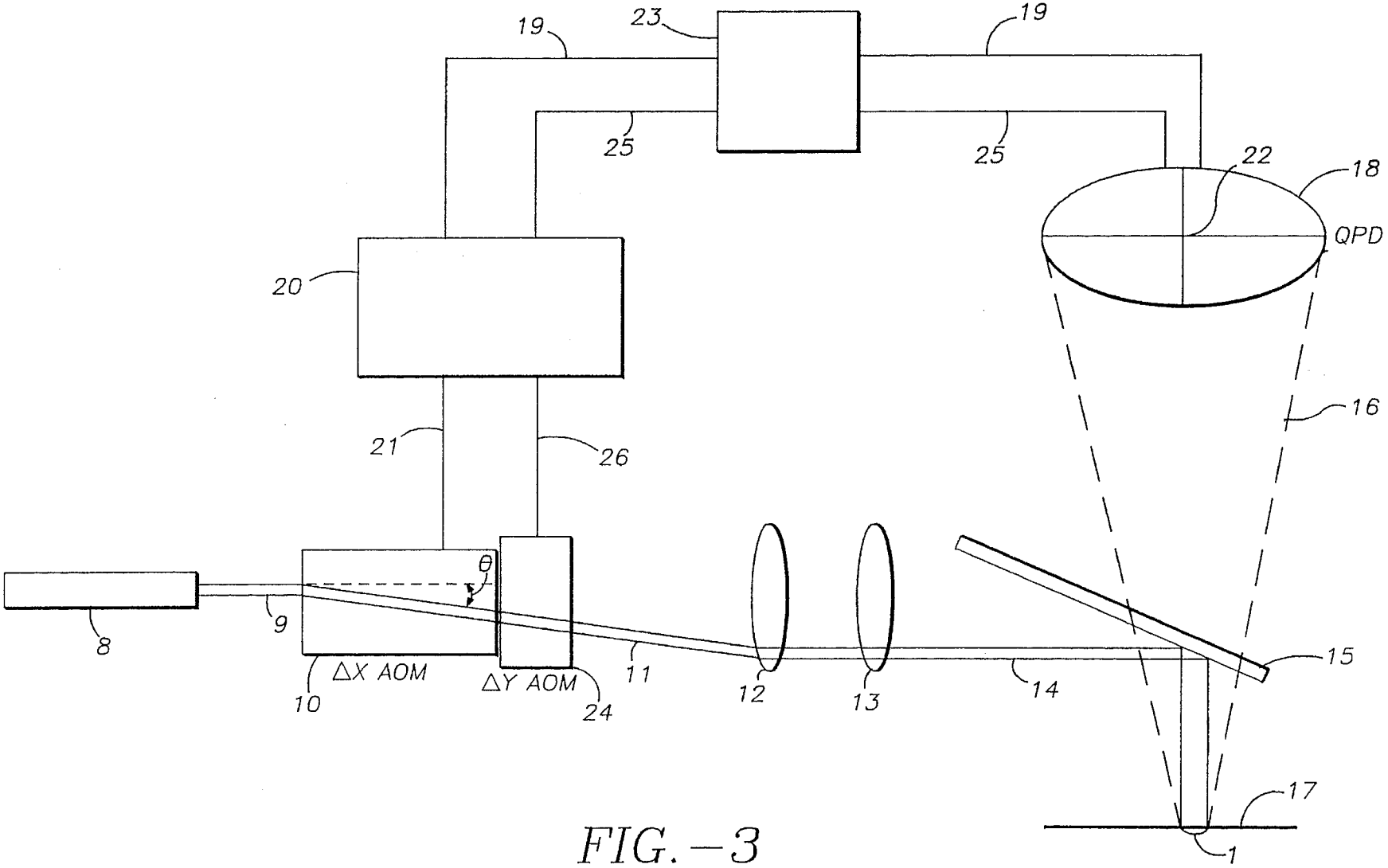
FIG. 3 is another embodiment of the present invention showing a variation of the embodiment of FIG. 2. Here, displacement in both the x- and y-axes can be corrected by the feedback signal.

For displacement in both the x and y axes of the focal point on the coverslip region, the configuration of FIG. 3 may be used. The feedback loop to compensate for the displacements in the x direction is provided by lines 19 and 21. Line 19 provides the electrical path for the photocurrent signal to electrometer 23. The converted voltage at the output of electrometer 23 is transmitted to VCO 20 which sends the appropriate sound wave to a Δx AOM 10 via line 21 to correct for displacements in the handle's x-axis position.

For displacements in the y-axis, a second line 25 from QPD 18 carries the appropriate displacement photocurrent to electrometer 23. The electrometer 23 converts the input current to voltage and provides the voltage value to the second input to VCO 20. The VCO 20 sends the appropriate sound wave to Δy AOM 24 via line 26 to deflect the incoming light beam at an angle α (in a direction normal to the page). Thus, the correction of the handle's position is provided by AOMs 10 and 24 for the x- and y-axis, respectively. If the handle's position is on-target, no correction signal (or a predetermined constant signal representing no displacement) is generated by QPD 18. This technique is particularly effective for small, fast displacements. Note that the two AOMs 10, 24 are orthogonally oriented with respect to each other for the x and y displacement corrections.

In previous discussions, only one optical trap was created. However, multiple optical traps may be formed. For example, two handles attached to the ends of an actin filament can be used to hold the actin filament taut and steady as it interacts with myosin and other protein molecules and enzymes. To keep the handles steady, two optical traps must be created with the focal region for each optical trap located at each handle position.

Figure 4:
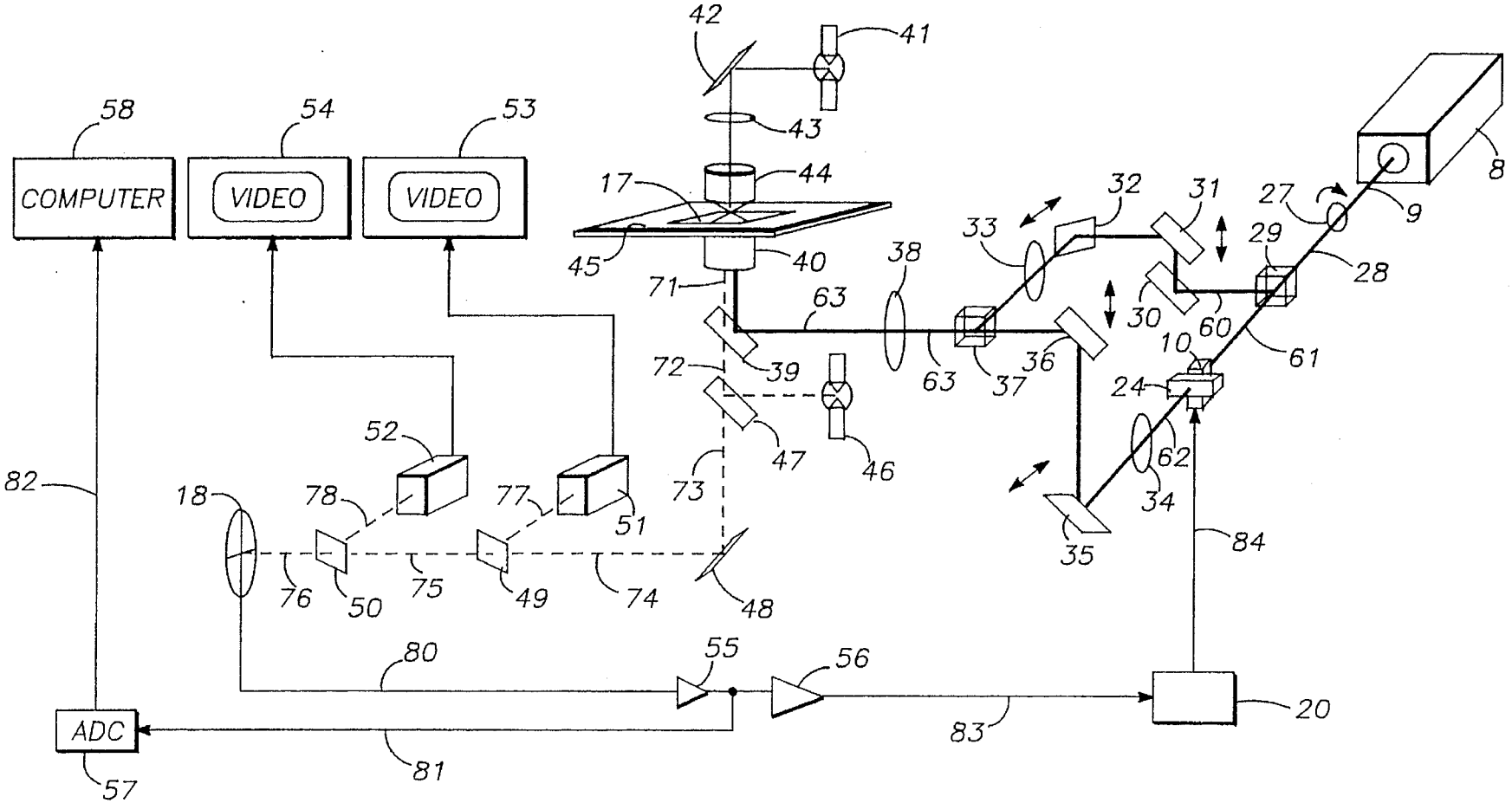
FIG. 4 is another embodiment of the present invention showing how two optical traps may be created with feedback positional control. The sample may also be observed using brightfield illumination and epifluorescence.

FIG. 4 represents another embodiment of the present invention utilizing two optical traps. Here, light source 8 is a Nd:YLF diode-pumped laser. The laser beam 9 enters half-wave plate 27. Because of the particular entry (at angle δ) of the laser beam 9 into half-wave plate 27, two beams are formed at the output of half-wave plate 27—one beam identical with the incoming incident laser beam 9 and another beam that is rotated at an angle −2δ from that of the incident laser beam 9. These two beams appear at light path 28.

These two beams are split at a first polarizing beam splitter 29 into two light paths 60 and 61. The light traveling along light path 60 encounters a directional mirror 30 and two crude focal region location means, such as motorized mirrors 31, 32. These mirrors can adjust focal positions and direct the light to collimating lens 33 and polarizing beam splitter 37. These motorized mirrors are used for crude positioning of one of the optical traps directed to handle 1 when the handle 1 encounters a large displacement. No feedback is provided for this light and focal point. In the other light path 61, the light goes through Δx compensating AOM 10 and Δy compensating AOM 24. These AOMs function as in FIG. 3. However, in this embodiment, the AOMs 10, 24 are used to automatically control the position of one of the handles (handle 2 in FIG. 1) for small, fast movements (for example, resolution <1 nm; response time about 10 μs). The Δx and Δy compensated light then travels along light path 62 to collimating and focusing lens 34. After encountering two motorized mirrors 35, 36, the light enters a second polarizing beam splitter 37. Like the other motorized mirrors along light path 60, motorized mirrors 35, 36 can adjust optical trap positions when the handle becomes displaced at large distances.

These two light beams of equal intensity enter second polarizing beam splitter 37 and at its output, travel along a new light path 63 toward collimating and focusing lens 38. These two light beams are reflected into the objective 40 via dichroic filter 39. On the coverslip 17, the two handles (not shown) attached to the ends of the actin filament (not shown) become optically trapped when the two light beams focus onto the location of the handles.

A 75 watt Xenon arc lamp 41 and a 100 watt Mercury arc lamp 46 may be set up to provide the necessary illumination of the sample for simultaneous real-time brightfield and epifluorescence observation, respectively, of the sample. The sample must be appropriately marked. These images may be observed with the aid of video cameras 51, 52 and video monitors 53, 54 simultaneously and in real-time. Video camera 51 and video monitor 53 may be used to view epifluorescence images, while video camera 52 and video monitor 54 may be used to view brightfield images.

Dichroic filters 39, 47, and 49 can be utilized in the system along appropriate light paths to separate laser light, brightfield illumination, and the epifluorescence. Xenon arc lamp 41 illuminates the sample on the coverslip 17 with the aid of mirror 42, filter 43, and condenser 44. For brightfield illumination, filter 43 passes light of wavelength greater than 700 nm, for example. Similarly, Mercury arc lamp 46 illuminates the sample on coverslip 17 with the aid of dichroic beam splitter 47 and objective 40.

The image of the sample, containing laser light, brightfield illumination, and epifluorescence, travels along light path 71, through the apertures of dichroic filter 39. The passband of the dichroic filter may be, for example, 450–1000 nm. The passing image along light path 72 encounters dichroic filter 47, which, for example, passes light of wavelength greater than 565 nm. The remaining image along light path 73 encounters directional mirror 48, which redirects the image along light path 74.

The filtered image along light path 74 then encounters dichroic filter 49, which passes light of wavelength 700–1000 nm, for example, along light path 75 and reflects image of wavelength 565–1000 nm, for example, along light path 77. Along light path 77, the epifluorescent image may be recorded with video camera 51 and viewed with video monitor 53.

Along light path 75, the image of wavelength 700–1000 nm (which includes laser light and brightfield illumination) encounters beam splitter 50, which sends an approximately equal component of the image toward light path 78 and another component toward light path 76. Along light path 78, the brightfield image of wavelength 700–1000 nm may be recorded with video camera 52 and viewed with video monitor 54.

Along light path 76, the image of wavelength 700–1000 nm (which includes the two laser light beams forming the optical trap on the coverslip 17) encounters QPD 18. As before, the QPD generates photocurrent along differential output line 80 that represents the Δx and Δy deviation from the target location of the handles. One handle (handle 1 in FIG. 1) trapped by light along light path 60 remains at a constant position. The other handle (handle 2 in FIG. 1) trapped by light along light path 61, however, deviates off-target and its position must be corrected with feedback.

Electrometer 55 converts incoming photocurrent into voltage levels. These voltages (one voltage level for x-axis correction and another voltage for y-axis correction), which represent the deviation of handle 2 (see FIG. 1) from its desired on-target location, are sufficiently amplified to provide acceptable input levels to VCO 20 along line 83. As before, the VCO 20 generates the appropriate sound waves along line 84 to AOMs 10 and 24 to correct handle position by deflecting the light beam in both the x and y axes. Thus, the handle position feedback is provided by QPD 18, electrometer 55, amplifier 56, VCO 20, and AOMs 10, 24.

The same voltages that served as inputs to the VCO 20 are also input to analog-to-digital converter 57 along line 81. The digital representation of the voltages signifying the off-target handle position is stored in computer 58. Signals were sampled at 4 kHz (R.C. Electronics, ISC-16), recorded on the computer 58, and subsequently filtered during analysis using up to 8 point averaging, and a 2–8 point Hanning filter. Essentially the same results were achieved by using steep-cut Bessel filters. Single displacement amplitudes were measured, using the minimum filtering possible, by fitting lines through the baseline noise on either side of an event, and (where possible) through the noise at the plateau of the event.

Other embodiments of the invention incorporates a galvanometer mirror and a PZT-type mirror in place of the AOMs 10, 24. A galvanometer is a device for indicating very small electric currents. When a mirror is attached to the moving element of the galvanometer, current amplitudes can move the mirror by an appropriate and proportional amount. Thus, the mirror serves as a means for amplifying small motions, typically radial motions, or current variations. Although a galvanometer mirror has a slower response (bandwidth is approximately 1 kHz) and a higher noise than an AOM, it has no practical limit on laser power.

Piezoelectric transducers (PZT) utilize piezoelectric crystals which become strained when subjected to electric fields. The strain or piezoelectric deformation is directly proportional to the electric field. Thus, in the embodiment shown in FIG. 4, feedback current signal from the QPD 18 may be converted to voltage by electrometer 55 and amplifier 56. This voltage level is then applied to the PZT mirror which can deflect the incoming light beam to any desired position. The PZT mirror features reasonable response (bandwidth up to 9 kHz), low noise, and high laser power capability. However, PZT mirrors suffer from hysteresis and creep which could be corrected with feedback.

The present invention may be particularly useful for observing protein molecule interactions with actin and myosin as well as measuring force and displacement resulting from the interaction of a single myosin molecule with a single actin filament at varying concentrations of adenosine triphosphate (ATP). Experimental results indicate that discrete stepwise movements averaging 11 nm were seen under conditions of low load, while single force transients averaging 3–4 pN were measured under isometric conditions. The magnitudes of the single forces and displacements are consistent with predictions of the conventional swinging crossbridge model of muscle contraction.

As shown in FIG. 1, the basic design of the experiment involved the firm attachment of silica beads 90 to a microscope coverslip 17 to provide a docking platform for myosin molecules. In this embodiment, the silica beads are each 1 μm diameter and manufactured by Bangs Laboratories. The silica beads 90 were firmly fixed to a microscope coverslip 17 by suspending them in 0.05% Triton X-100 and spreading them onto the coverslip, which was then air dried. The surface was then either coated with nitrocellulose or siliconized by treatment with 0.2% dichloro-dimethyl-silane (Dow Corning, Z1219) in chloroform.

As shown in FIG. 4, the coverslip 17 rests on a substage 45 which comprises piezo-electric-transducers (PZT) for calibrating force. One type of PZT is a Physik Instruments P771. The force is shown on FIGS. 7A and 7B. This coverslip 17 was used to construct a flow cell as in the myosin-coated surface in vitro motility assay. The coverslip 17 was then coated with skeletal muscle heavy meromyosin (HMM) 91 (see FIG. 1 ) at a density that was observed to be insufficient to support continuous movement of actin filament 3.

Rabbit skeletal muscle HMM (1–5 μg $ml^{-1}$) was applied to the flow cell for 2 min. Polystyrene beads (1.0 μm MX Covaspheres, Duke Scientific), or handles 1, 2, labeled with NEM-HMM as described were mixed with rhodamine-phalloidin labeled actin filaments at a ratio of approximately 1 handle to 10 μm F-actin prior to being applied to the flow cell in motility buffer (25 mM KCl, 4 mM $MgCl_2$ 1 mM EGTA, 10 mM DTT, 25 mM imidazole, pH 7.4) at 21° C.

Two handles 1, 2 were placed on an actin filament 3 near its ends (typically 5–10 μm apart) with each handle held in an optical trap. The most successful technique was to use one optical trap to hold a handle 1 with an actin filament 3 already attached. The actin filament 3 was then straightened by a solution flow produced by the motorized stage controls, and a second handle 2 maneuvered by the second optical trap was attached to the free end of the actin filament. The actin filament was then pulled taut by moving the second handle 2 and the actin filament was lowered onto the silica bead 90 using the fine focus of the microscope objective. The optical trap design used a Nd:YLF diode-pumped laser (Spectra-Physics, TFR, 1.047 μm) and a custom-built inverted microscope with a high numerical aperture objective (Zeiss, 63X Planapochromat, DIC 1.4 NA).

Two optical traps were produced by splitting the laser beam before the AOMs 10, 24 using a half-wave plate (λ/2) 27 followed by a polarizing beam splitter 29. The traps were the same strength (12 mW, measured before the objective 40). One trap position, corresponding to handle 2 in FIG. 1, was controlled for small, fast movements (resolution <1 nm; response time about 10 μs) using the AOMs 10, 24 (Isomet, 1206C), and both trap positions were controlled for larger, slower movements using DC motors (Newport, 860A-1-HS) to move mirrors 31, 32, 35, 36. An example of a QPD 18 used is a Hamamatsu S1557. Δx and Δy were obtained by appropriate additions and subtractions of the four quadrant outputs. The bandwidth was 100 Hz, limited by the 200 MΩ resistors used in the electrometer 55 and stray capacitance. The laser power was 12 mW and each optical trap had a stiffness of 0.02 pN/nm.

Polystyrene beads, or handles 1, 2, coated with N-ethylmaleimide (NEM)-treated HMM were attached to actin filaments 3 and applied to the flow cell in the presence of ATP. An actin filament 3 with a handle attached near each end was caught and held in mid-solution with two optical traps. The embodiment shown in FIG. 4 was used to set up the optical traps and conduct the experiment.

The brightfield image of one of the handles (handle 2) was projected onto a QPD 18 for high resolution position detection. For displacements of the handle up to approximately 200 nm away from the center of the trap, the handle position is proportional to an applied force acting on the head, so that force as well as displacement measurements were possible. As shown in FIG. 1, the actin filament 3 was pulled taut by moving the second handle 2 until the force on the actin filament 3 was approximately 2 pN. The actin filament 3 was then brought close to the surface of the coverslip 17 so that it could interact with one or a few HMM molecules on the silica bead support 90.

In order to study myosin movement under conditions of low load, it was necessary to use relatively compliant optical traps. The stiffness of each trap (0.02 pN/nm; total stiffness opposing motion 0.04 pN/nm) was chosen to be as large as possible to decrease the amplitude of the Brownian motion of the handles while not exceeding a force that would impede a myosin molecule from producing its full displacement. Brownian motion, as is well known in the art, is the irregular motion of any body or molecule suspended in gas, liquid, or solid due to its collisions with other molecules in the medium. The thermal motion of the particles in the medium will impart energy and momentum to a body or molecule in the medium. The motion of the body or molecule will appear irregular and erratic because of fluctuations in the magnitude and direction of the average momentum transferred. In experiments such as this, Brownian motion is treated as noise.

Figure 5A:
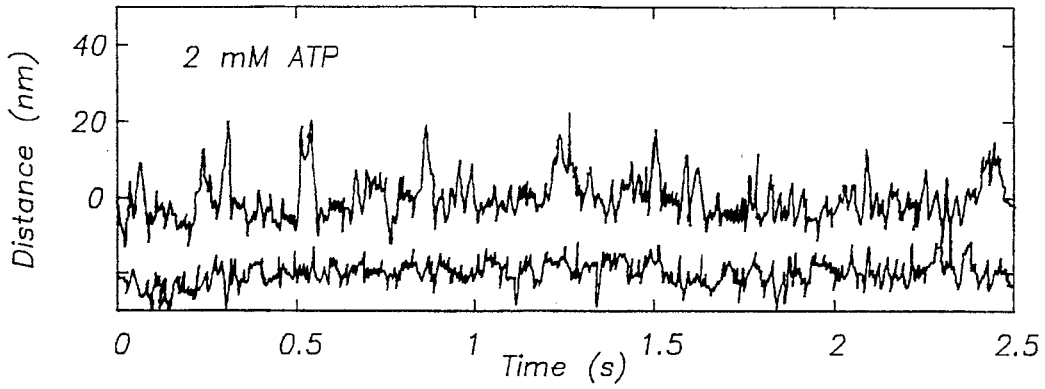
FIGS. 5A–B show the displacement of the actin filament in the presence of various concentrations of adenosine triphosphate (ATP).

At saturating concentrations of ATP (2 mM), when the actin filament 3 was brought in contact with a sparsely coated surface on the silica bead support 90, the trapped handles 1, 2 attached to the actin filament showed rapid transient movements in the direction along the actin filament 3 (see FIG. 5A, top trace), but not in the direction perpendicular to the actin filament 3 (see FIG. 5A, bottom trace). These displacements were almost without exception in one direction, presumably corresponding to the polarity of the actin filament. The leading and falling edges of the displacements were typically as fast as the response time of the measuring system (a few milliseconds).

At saturating ATP concentration (2 mM), the average size and duration of the single displacements were 12 nm and ≦7 ms, respectively (Table 1). The duration was close to the resolution of measurement. Therefore, the ATP concentration was lowered to 1 μM or 10 μM to delay the dissociation of myosin from actin. These concentrations are well below the apparent $K_m$ (~50 μM) for the sliding velocity.

Table 1 is as follows:

TABLE 1

| | Average single myosin molecule measurements* | | | |
|---|---|---|---|---|
| ATP concentration | Single displacements (nm) | Displacement durations (MS) | Single forces (pN) | Force durations (MS) |
| 2 mM | 12 ± 2.0 (22) | ≦7 (22) | 3.4 ± 1.2 (85) | 18 ± 6 (85) |
| 10 μM | 11 ± 2.6 (36) | 72 ± 29 (36) | 3.5 ± 1.3 (43) | 25 ± 9 (43) |
| 1 μM | 11 ± 2.5 (21) | 260 ± 140 (21) | 3.4 ± 1.4 (50) | 190 ± 150 (50) |

*Values shown are mean ± standard deviation (n).
The differences between force and displacement durations were examined for statistical significance, using error estimates obtained from the distribution of the means of experimental runs. At 2 mM and 10 μM ATP these differences were highly significant ($p < 0.01$), but at 1 μM ATP the difference was not significant.

Figure 5B:
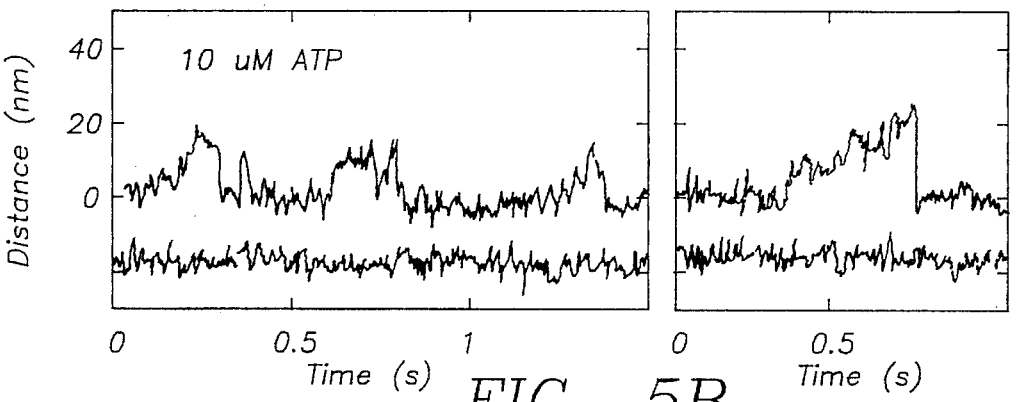
Figure 5C:
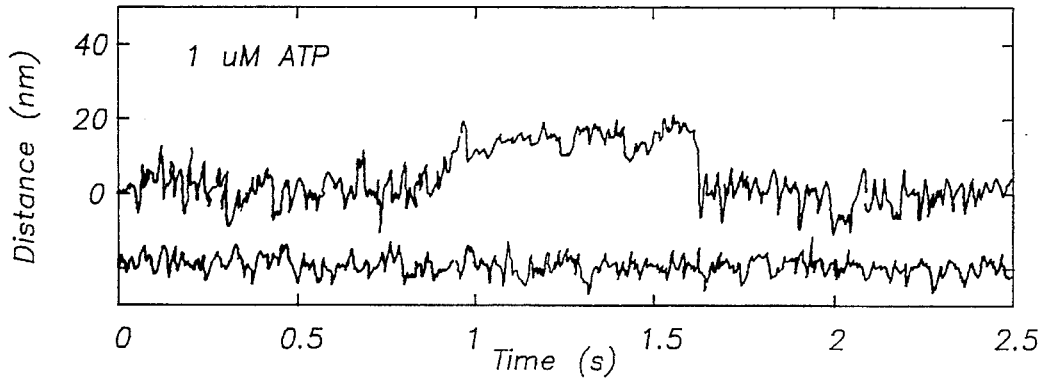
FIG. 5C shows actin filament displacement in the presence of 1 μM of ATP.

The HMM density was also decreased, to the point where many of the actin filaments tested showed no transient displacements, so that when interactions were detected they most likely involved only one or a very few molecules. Single displacements were detected above the noise at 10 μM ATP (see FIG. 5B) and 1 μM ATP (see FIG. 5C). In many test results, the Brownian noise was markedly reduced during the steps, presumably because of the increased stiffness associated with the HMM-actin link.

The size of the steps, 11±2.4 nm (mean±s.d.), was the same at both high and low ATP concentrations, but the average duration of the displacements increased as the ATP concentration decreased (Table 1). The peak amplitude distribution was independent of total trap stiffness over the range 0.014–0.08 pN/nm, implying that the step size is independent of load in this range.

Figure 5D:
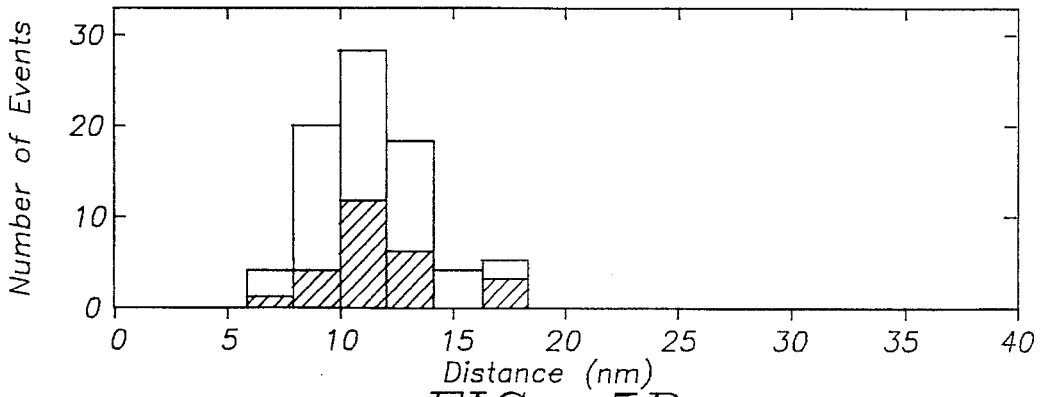
FIG. 5D shows that similar results were obtained when siliconized surfaces and nitrocellulose-coated surfaces were used on the silica bead support at ATP concentrations of FIGS. 5A, 5B, and 5C.

This experiment was performed using both siliconized surfaces and nitrocellulose-coated surfaces with similar results. FIG. 5D shows the distribution data obtained from both siliconized surfaces (white) and nitrocellulose surfaces (shaded).

Figure 6A:
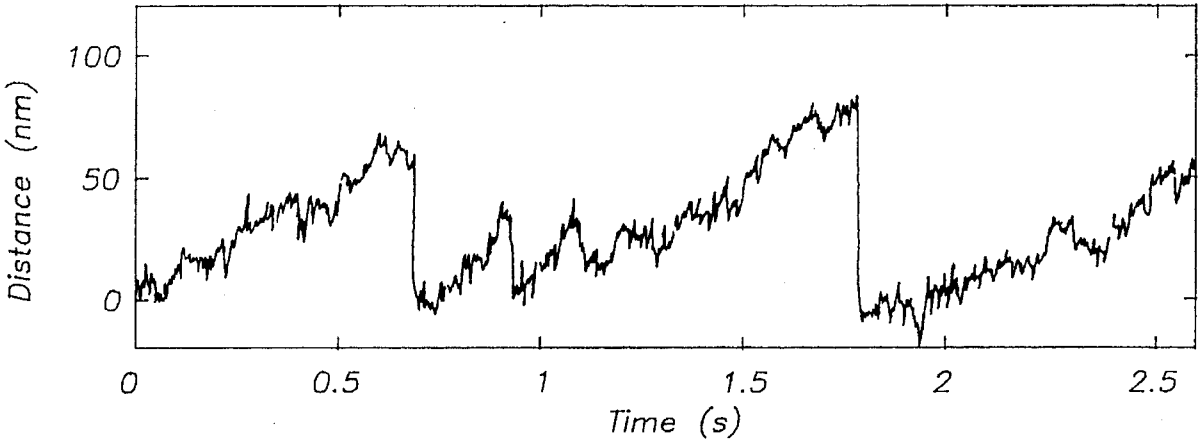
Figure 6B:
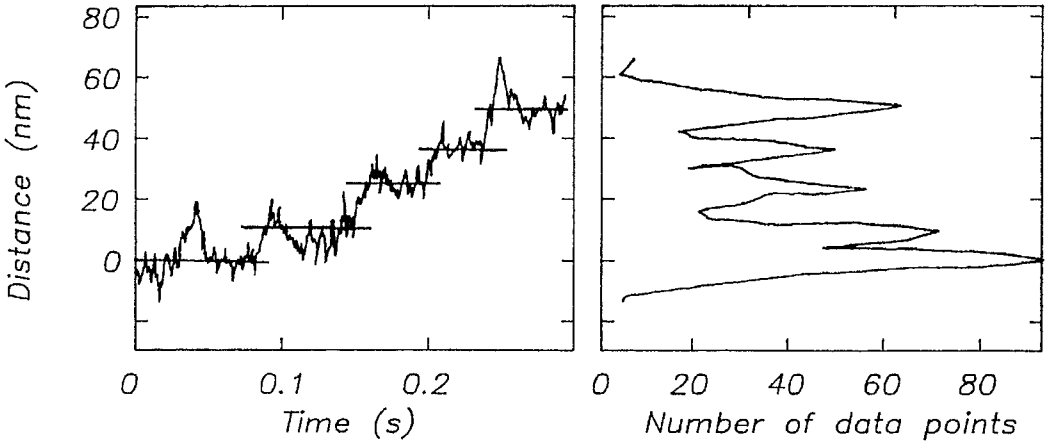

When the HMM density on the surface was increased to levels just below that which supported continuous movement of actin over large displacement, the trapped handle no longer returned to its original desired baseline position after each displacement. Instead the handle moved for distances larger than a single step before abruptly returning to the baseline (see FIG. 6A). At the trap stiffness used in these measurements, a free handle returns to its equilibrium position with a time constant of <1 ms so that each rapid return to the baseline in these experiments probably corresponded to a period when there were no molecules bound to the actin filament. This would be expected to occur frequently at the subsaturating HMM densities used in these measurements. In many instances the handle clearly moved in a few discrete steps (FIG. 6B, left panel) before returning to the baseline. This feature is quantitated in FIG. 6B (right panel), which is a histogram that shows the distribution of distances away from the baseline as a function of time spent at each distance. The handle spent long periods of time at discrete levels and moved quickly between levels. The distance between levels averaged 11±3.0 nm (mean±s.d.) (see FIG. 6C), which is consistent with the size of the single movements shown in FIG. 5 and Table 1. Since such multiple steps were observed infrequently at very low surface densities, it is likely that they correspond to a small number of molecules attaching to a filament and moving it sequentially.

Figure 7C:
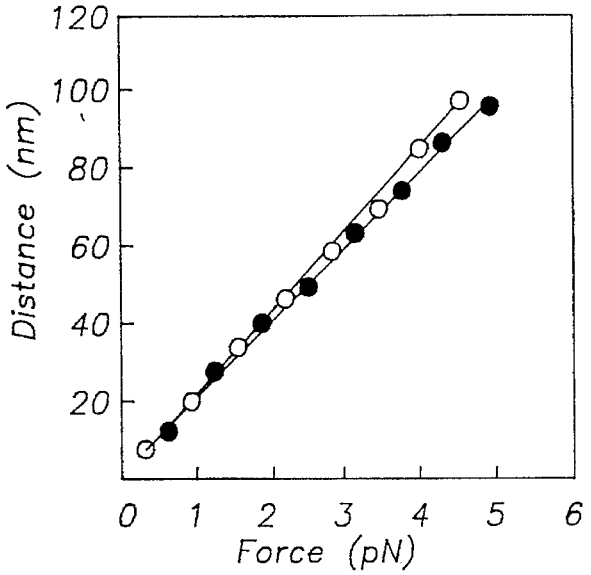
Figure 8A:
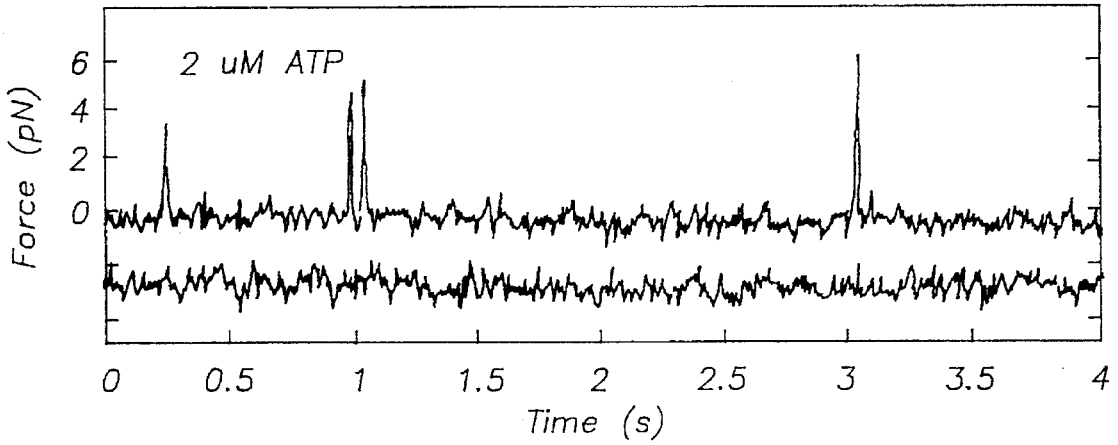
FIGS. 8A–D show single force transients at constant low HMM densities and varying ATP concentrations.
Figure 8B:
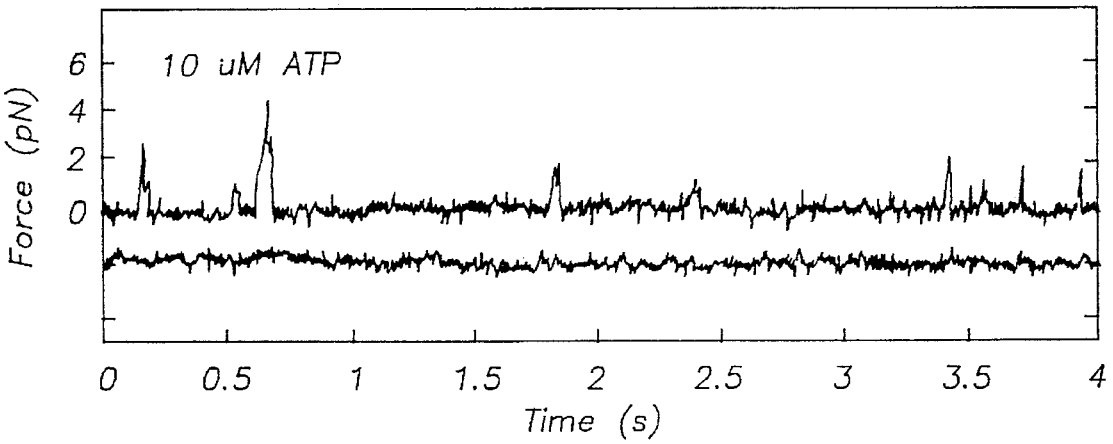
Figure 8C:
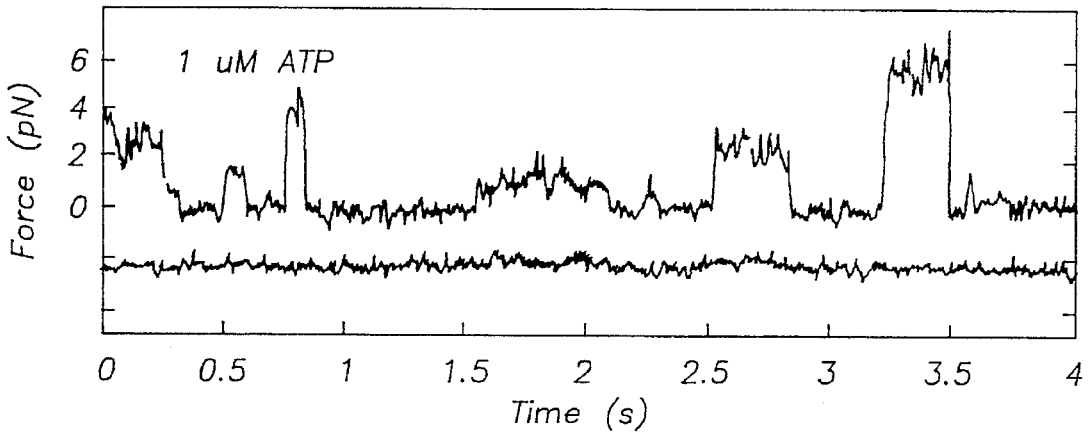
Figure 8D:
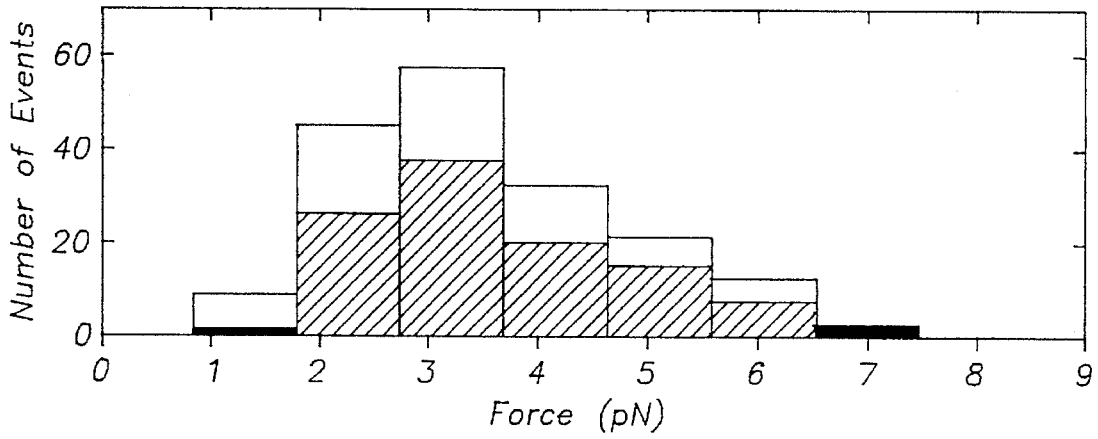

In order to measure the force produced by HMM molecules, a much stiffer trap was needed than was used to measure displacements. The trap stiffness was increased to 6 pN/nm by means of a feedback system in which the QPD 18 output signals were fed into the driver circuits for AOMs 10, 24 which were used for deflecting incoming light and thus, making rapid trap displacements. When an external force in the form of a viscous drag was applied to a trapped handle without feedback (handle 1 corresponding to the focal point from light path 60) the handle was displaced from the center of the trap (FIG. 7A), and this displacement was directly proportional to the force applied (FIG. 7C). In contrast, when the feedback loop was closed, the center of the trap moved by an amount proportional to the applied force and the handle was essentially prevented from moving (FIG. 7B). Thus, the displacement of the trap position could be used as a measure of force on the trapped handle under approximately isometric conditions.

To get a clearer understanding of the forces with and without feedback, refer to FIG. 7A and 7B. In FIG. 7A, without feedback, a viscous force that alternated in direction was applied to a trapped handle by applying a triangular wave (lower trace) to the microscope substage 45 position. The handle position showed an approximately square wave response. With feedback, the optical trap position showed an approximately square wave response, and the handle remained essentially stationary, as shown in FIG. 7B. The trap stiffness under feedback control increased by approximately 300 fold from 0.05 pN/nm without feedback to 5 pN/nm with feedback.

The procedure for measuring single forces was as follows. When an actin filament was brought in contact with HMM molecules and single displacements were observed, the feedback loop was closed and force fluctuations were then measured. At sufficiently low HMM densities, single force transients were observed (FIG. 8). Just as for displacements at low load, forces were nearly always found to be in one direction along a particular actin filament. The magnitude of the forces covered a broad distribution, ranging from 1 to 7 pN, and averaged 3.4±1.2 pN (mean±s.d.) (FIG. 5D). The distribution of forces was the same at the different ATP concentrations (Table 1). As observed for the single displacements at low load, the duration of the single force transients increased at low ATP concentrations (Table 1). At these low HMM densities, the force transients usually appeared as isolated events, but at slightly higher densities the events occurred very close together and often were additive (data not shown). This is the corresponding process to multiple steps at low load, and presumably is due to the overlapping action of several HMM molecules.

The ability to measure the mechanical properties of single myosin molecules provided direct evidence that under conditions of low load, myosin undergoes stepwise displacements with an average step of about 11 nm, and under isometric conditions, myosin produces an average force of 3–4 pN. These values are well within the range of those allowed by the swinging crossbridge model. Furthermore, the data showed that the durations of the transient displacements and forces are ATP concentration dependent so that, at least at low ATP, each interaction requires the completion of the ATP hydrolysis cycle. In addition, the durations are very close to those which would be expected for single ATP hydrolysis cycles.

Although the present invention has been described with reference to a particular embodiment, additional embodiments, applications, and modifications that are obvious to those skilled in the art or are equivalent to the disclosure are included within the spirit and scope of the invention. Therefore, this invention should not be limited to the specific embodiment discussed and illustrated herein, but rather by the following claims and equivalents thereof.

We claim:

1. An optical system for optically trapping first and second spaced particles comprising:

a light source forming a light beam;

beamsplitting means for receiving said light beam and forming first and second light beams;

means for focusing said first and second light beams to first and second focal regions, first optical processing means for directing said first light beam so that the first focal region impinges on the first particle, second optical processing means responsive to a drive signal for controlling the direction of the second light beam to control the multi-dimensional position of the second focal region on the second particle to position the particle;

a detector for detecting the multi-dimensional position of the second particle image and generating a signal representative of the deviation of the position of the second particle image on the detector from a desired target position of the second particle image on the detector, wherein the signal is provided to a driver; and a driver for converting a signal from the detector into a drive signal to the second optical processing means.

2. An optical system for forming an optical trap in a sample region as in claim 1, wherein said second optical processing means includes an acousto-optic modulator.

3. An optical system as in claim 1, wherein said second optical processing means includes a galvanometer mirror.

4. An optical system as in claim 1, wherein said second optical processing means includes a PZT mirror.

5. An optical system as in claim 1, wherein the second optical processing means further comprises a beamsplitter for directing light onto the sample region and reflected light from the particle onto the detector.

6. An optical system for forming an optical trap in a sample region as in claim 1, wherein the driver is a voltage-controlled oscillator.

7. An optical system as in claim 1, wherein the detector is a quadrant photodiode detector.

8. An optical system as in claim 1, wherein the second optical processing means controls the location of the focal region by deflecting the light beam in the x and y directions.

* * * * *